US006604835B2

(12) United States Patent
Zale

(10) Patent No.: US 6,604,835 B2
(45) Date of Patent: Aug. 12, 2003

(54) DECORATIVE LAVA LAMP

(75) Inventor: Stanley Zale, New York, NY (US)

(73) Assignee: Louis Glick Diamond Corp., New York, NY (US)

( * ) Notice: Subject to any disclaimer, the term of this patent is extended or adjusted under 35 U.S.C. 154(b) by 0 days.

(21) Appl. No.: 09/944,582

(22) Filed: Sep. 4, 2001

(65) Prior Publication Data

US 2003/0043572 A1 Mar. 6, 2003

(51) Int. Cl.[7] ..... F21V 33/00

(52) U.S. Cl. ..... 362/101; 362/318; 362/96; 362/806

(58) Field of Search ..... 362/101, 96, 318, 362/806; 40/406, 407; 472/137

(56) References Cited

U.S. PATENT DOCUMENTS

| | | | | |
|---|---|---|---|---|
| 201,864 A | | 4/1878 | Behn, Sr. | |
| 2,644,890 A | | 7/1953 | Hollihan | |
| 2,714,927 A | | 8/1955 | Stern et al. | |
| 2,984,064 A | | 5/1961 | Russell et al. | |
| 3,387,396 A | | 6/1968 | Smith | |
| 3,724,847 A | | 4/1973 | Compton | |
| 3,935,702 A | | 2/1976 | Tamada | |
| 4,030,285 A | | 6/1977 | Sheth | |
| 4,034,493 A | | 7/1977 | Ball | |
| 4,196,899 A | * | 4/1980 | Patterson | 472/137 |
| 4,474,481 A | | 10/1984 | Croyle | |
| 4,648,721 A | | 3/1987 | Shapiro | |
| 4,844,447 A | | 7/1989 | McKnight | |
| 5,117,405 A | | 5/1992 | Thibault | |
| 5,122,994 A | | 6/1992 | Benedetti | |
| 5,528,561 A | | 6/1996 | Castanis | |
| 5,778,576 A | | 7/1998 | Kaviani | |
| 5,803,580 A | * | 9/1998 | Tseng | 362/96 |
| 6,135,604 A | * | 10/2000 | Lin | 362/101 |
| 6,186,637 B1 | * | 2/2001 | Murrietta | 362/101 |
| 6,206,536 B1 | | 3/2001 | Lin | |
| 6,241,359 B1 | * | 6/2001 | Lin | 362/96 |

FOREIGN PATENT DOCUMENTS

| | | |
|---|---|---|
| JP | 58-150883 | 9/1983 |

* cited by examiner

*Primary Examiner*—Sandra O'Shea
*Assistant Examiner*—Ronald E. DelGizzi
(74) *Attorney, Agent, or Firm*—Stephen E. Feldman

(57) ABSTRACT

A decorative lava lamp includes a housing having one or more dense fluids therein, with discrete granules, such as gems or diamonds floating therein, wherein the lava lamp includes a light underneath. A lamp base both illuminates the lava lamp and heats the one or more dense fluids. The internal illumination from the bottom adds a decorative dimension that cannot be duplicated by external lighting. The brilliant gems sparkle and throw off shadows in the vicinity when placed in a dimly lit area. The heated silicone fluid rises in the center of the lower portion of the lava lamp lifting gem granules within the housing where they gently fall again due to the cooling of the silicone oil in contact with the enclosure. This creates a dynamic light show.

21 Claims, 1 Drawing Sheet

FIG. 1
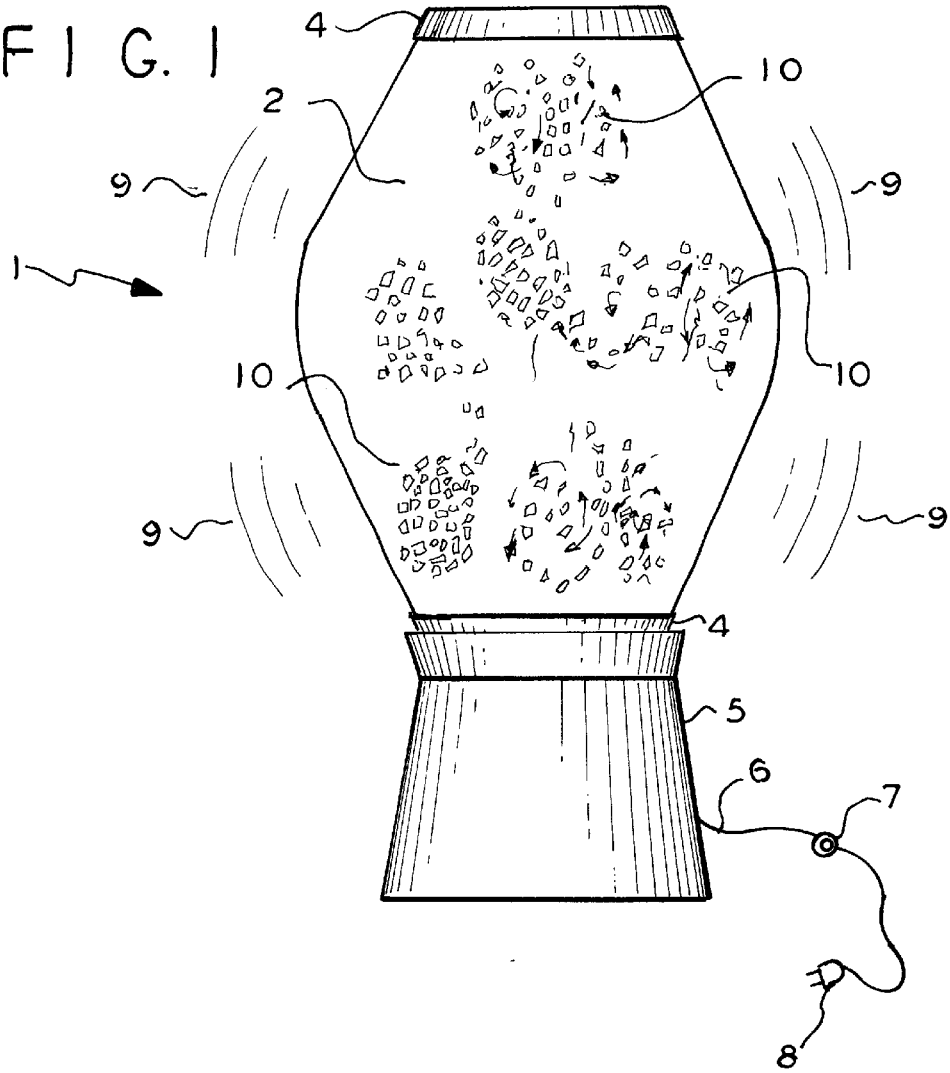
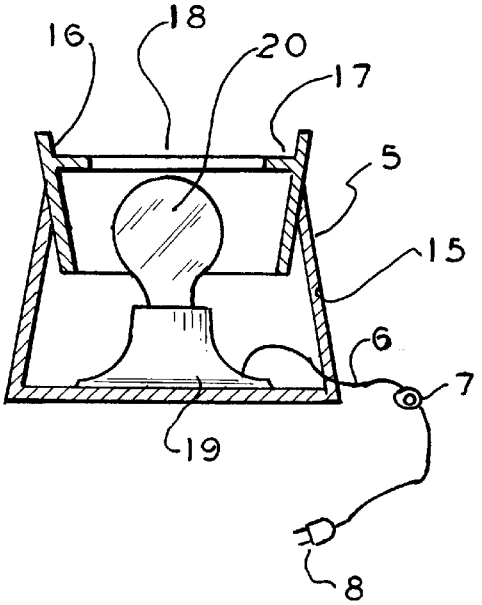
FIG. 2

DECORATIVE LAVA LAMP

FIELD OF THE INVENTION

The present invention relates to decorative lava lamps.

BACKGROUND OF THE INVENTION

Lava lamps are decorative lamps wherein a globule or globules of one liquid is suspended in another liquid, and the application of heat to a transparent or translucent container causes connection currents which give rise to the display of the globule or globules simulating the flow of volcanic lava.

A decorative lava lamp display device described in U.S. Pat. No. 3,387,396 of Smith reveals an electric lamp in the form of an electric bulb in a base illuminating and heating a transparent enclosure containing two different immiscible fluids of slightly different densities. In Smith '396, globules of contrasting colored dense fluids gently flow upward and then downward under the influence of internal convection currents and gravity. This decorative lamp of Smith '396 is quite entertaining and millions of "Lava Lamps" incorporating these features have been sold. However, while being self-illuminating, a source of soft light, and highly decorative, this type of lamp of Smith '396 does not display granules of gems, such as diamonds, flowing therethrough.

Among other related patents include U.S. Pat. No. 4,142,383 of Eberhart for a decorative objects, such as earrings, that include diamonds among other particles within the fluid, and U.S. Pat. No. 5,013,145 of Croll, which discloses eyeglass lenses with fluid therein, wherein the fluid has decorative granules, such as diamond speck particles therein. However, Eberhart '383 and Croll '145 do not describe lava lamps.

Among decorative timepieces include U.S. Pat. No. 2,714,927 of Stern, which describes a decorative timing object with silicone fluid supporting particles therein, wherein the falling rate of the particles indicates lapsed time. U.S. Pat. No. 2,984,064 of Russell is similar for a pivoting timepiece.

However, neither Stern '927 nor Russell '064 describe lava lamps which utilize the flow of lighted gems within one or more dense fluids, which greatly enhances the decorative aspects of the lava lamp.

Decorative hour glasses are disclosed in U.S. Pat. No. 4,030,285 of Sheth, which describes an electronic clock that simulates the operation of hour glasses by the use of lights, U.S. Pat. No. 5,122,994 of Benedetti, which describes an hour glass mounted to a transparent lighted table top and U.S. Pat. No. 6,206,536 of Lin, which discloses a table lamp having an ornamental movable hour glass container.

In addition, decorative hour glasses are also disclosed in U.S. Pat. No. 5,428,561 of Castanis, which describes an hour glass using colored sand for decorative effects and in Japanese Laid-Open publication no. JP 57033664 of Mar. 2, 1982, which discloses a decorative electronic hour glass, wherein display elements are sequentially lit depending upon the position or inversion of the hour glass.

However, these decorative hour glasses do not use vibrant, lighted granules of gems, such as diamonds, flowing through a lava lamp.

OBJECTS OF THE INVENTION

It is therefore an object of the present invention to provide a decorative lava lamp having one or more immiscible fluids therein, with visually perceivable particles of precious gems, such as diamonds, floating therein, wherein the lava lamp has a light underneath to cause illumination and movement of the particles within the immiscible fluids.

It is also an object of the present invention to provide a decorative lava lamp which utilizes rough, uncut gemstones in a medium which insulates the inner surface of the lava lamp housing from damage and which promotes the smooth flow of the granules within the housing of the lava lamp.

Other objects which become apparent from the following description of the present invention.

SUMMARY OF THE INVENTION

In keeping with these objects and others which may become apparent, the present invention is a decorative lava lamp incorporating uncut diamonds or other precious gems floating within one or more globules of dense fluids, such as silicone fluid. The lava lamp is mounted upon a lighted lamp base, which functions as a light and heat source, thereby affording several enhancements. The lamp in the lamp base both illuminates the lamp housing and the contents therein, and heats the silicone fluid or fluids, causing convection currents of the fluids.

The lava lamp of the present invention enhances the decorative aspects of a lava lamp by incorporating large or small cut or uncut diamonds or other precious gems in the transparent lava lamp housing enclosure filled with the silicone oil. The addition of sparkling gems to the flowing globules of fluids greatly enhances the decorative aspects while maintaining its utility as a lava lamp.

The use of one or more dense fluids, such as silicone oil, provides the decorative lava lamp with an insulating medium which insulates the inner surface of the hour glass housing from damage and which promotes the smooth flow of the granules throughout the lava lamp housing.

The internal illumination from the bottom adds a decorative dimension that cannot be duplicated by external lighting. The brilliant gems sparkle and throw off shadows in the vicinity of the lava lamp when it is placed in a dimly lit area. The heated silicone fluid or fluids rise as one or more globules in the center of the lower portion of the lava lamp, lifting gem granules within the lava lamp, where they gently fall within the silicone oil or other dense fluid in contact with the sealed interior of the lava lamp.

This creates a dynamic light show. The translucent nature of the gem granules gathered within the lamp housing glow and sparkle with internal light which also flows into the upper part of the lava lamp giving off a pleasant soft glow.

The important timing function of the lava lamp is maintained with this lamp feature. The synergistic combination of the lamp base with the unique composition of the decorative lava lamp provide effects that are not possible with any other type of lava lamp.

In a preferred embodiment, the decorative lava lamp includes a hollow lamp cylindrical housing preferably narrow at its top and bottom end, and wider at its equatorial mid point, having a visually perceivable inner surface. While the housing can be optionally cylindrical the lava lamp housing preferably has a top generally conical member connected to a bottom generally conical member, with a one or more dense fluids, such as an immiscible silicone oil supporting a plurality of discrete granules in the lava lamp housing. Visual effects are emitted during flow of the discrete granules within flow of the one or more dense liquids within the lava lamp housing. Preferably, the discrete granules are particles of gemstones, such as diamonds.

The dense liquids within the lava lamp housing are of sufficient viscosity, to act as a lubricant between the granules and the inner surface of the transparent or translucent housing. In the preferred embodiment, the electric light source illuminates one end of the lava lamp housing at the bottom and heats the dense liquids, causing the granules to gently flow upward to the top by internal convection currents within the dense fluids. The electric light source is preferably within the base upon which the lava lamp housing is mounted. The electric lamp illuminates and heats the dense fluid within the lava lamp housing.

BRIEF DESCRIPTION OF THE DRAWINGS

The present invention can best be understood in connection with the accompanying drawings. It is noted that the invention is not limited to the precise embodiments shown in drawings, in which:

FIG. 1 is a side elevational view of a decorative lava lamp of the present invention; and, FIG. 2 is a side phantom view of the lamp base portion of the present invention.

DETAILED DESCRIPTION OF THE INVENTION

The present invention has broad applications to many technical fields for a variety of articles. For illustrative purposes only, a preferred mode for carrying out the invention is described herein, wherein a decorative lava lamp utilizes the flow of discrete granules within one or more lighted and heated dense fluids.

While lava lamps may have different shapes, such as cylinders they generally include two conical members joined at a wide mid-section, through which the discrete granules flow to measure elapsed time.

FIG. 1 shows a side view of the decorative lava lamp 1 of the present invention. Transparent housing 2 may be glass or a transparent resin such as polycarbonate.

The interior of lava lamp housing 2 is filled with one or more dense fluids, such as silicone oil, such as manufactured by Dow Corning, Ltd., which both lubricate and protect the inner surface as well as slow down the progress of gem granules 3 in falling through housing. Other dense liquids with suitable viscosity and chemical characteristics may also be used.

While the diamonds granules can float within a single dense fluid, such as silicone oil, preferably two or more dense fluids are used, wherein globules form within one of the fluids, floating within the second fluid.

The silicone fluids coat the discrete granules within housing 2, causing them to slide off of each other and flow up and down within housing 2. The flow rate of the diamonds depends upon the number and size of the discrete granules, and the viscosity of the dense fluid and other related factors.

Decorative bands 4 at each end of housing 2 hide any closure element such as an O-ring which may have been used during the sealing operation at one end.

Housing 2 is supported by lamp base 5 with line cord 6 supplying electric power through switch 7 and electric plug 8. The heat from lamp base 5 causes convection currents 10 in the lower portion of hourglass glass housing 2 which induces the gem granule 3 flow as shown. Light from lamp base 5 is emitted as a soft glow 9 through the surfaces of housing 2.

FIG. 2 is a phantom side elevational view of lamp base 5 revealing lamp socket 19 and incandescent lamp 20.

Base 5 housing 15 may be composed of a wide variety of heat resistant materials such as thermoset plastic or more decorative materials such as metal or marble. Inner reflector 16 reflects light from lamp 20 toward the transparent bottom of hour glass housing 2 through opening 18 in support ring 17 (which supports the lava lamp).

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A decorative lava lamp comprising:

a hollow transparent cylindrical lamp housing having a visually perceivable inner surface;

a plurality of discrete diamond granules in said lava lamp housing;

at least one dense immiscible liquid comprising silicone within said lava lamp housing of sufficient viscosity, to act as a lubricant between said granules and said inner surface of said lava lamp housing; and, an electric light source illuminating at least one end of said lava lamp housing and heating said housing containing said at least one dense liquid;

wherein said granules gently flow within said housing under the influence of internal convection currents within said at least one dense fluid and by the force of gravity.

2. The lava lamp as in claim 1 wherein said housing has a generally top conical member connected by a wide equatorial mid-section to a bottom generally conical member.

3. The lava lamp as in claim 1 wherein said housing is cylindrical.

4. The lava lamp as in claim 1 wherein said granules are gems.

5. The lava lamp as in claim 4 wherein said granules are diamonds.

6. The lava lamp as in claim 1 wherein said at least one light source is an electric lamp illuminating and heating said dense fluid within said lava lamp housing.

7. The lava lamp as in claim 1 wherein said at least one dense fluid is an immiscible fluid.

8. The lava lamp as in claim 1 wherein said at least one dense fluid is silicone oil.

9. The lava lamp as in claim 1 wherein said at least one dense fluid is a plurality of dense fluids, wherein one of said fluids forms at least one globule flowing within said other dense fluid.

10. The lava lamp as in claim 1 wherein said at least one dense fluid flows under the influence of internal convection currents and the force of gravity.

11. The lava lamp as in claim 10 wherein said heated dense fluid rises in the center of the lower portion of said lava lamp housing, said heated dense fluid lifting said granules falling through said housing of said lava lamp.

12. The lava lamp as in claim 1 wherein said lava lamp housing is transparent.

13. The lava lamp as in claim 1 wherein said lava lamp housing is translucent.

14. The lava lamp as in claim 1 wherein said lava lamp housing is made of glass.

15. The lava lamp as in claim 1 wherein said lava lamp housing is made of a resin.

16. The lava lamp as in claim 15 wherein said lava lamp housing is made of polycarbonate.

17. The lava lamp as in claim 1 further comprising at least one decorative band at each end of said lava lamp housing, said at least one decorative band hiding a closure element used during fluid sealing of said lava lamp.

18. The lava lamp as in claim 1 wherein said lamp base includes a line cord supplying electric power through a switch and an electric plug.

19. The lava lamp as in claim 18 wherein said lamp base includes a lamp socket and an incandescent lamp.

20. The lava lamp as in claim 19 wherein said lamp base is heat resistant.

21. The lava lamp as in claim 1 further comprising an inner reflector reflecting emitted light from said lamp toward a light transferable bottom of said lava lamp housing.

* * * * *